US011719466B2

(12) United States Patent
Branecky et al.

(10) Patent No.: US 11,719,466 B2
(45) Date of Patent: Aug. 8, 2023

(54) ELECTRONIC UNLOCK FEATURE

(71) Applicant: A. O. SMITH CORPORATION, Milwaukee, WI (US)

(72) Inventors: Brian Thomas Branecky, Oconomowoc, WI (US); William Gordon Hosken, Atlanta, GA (US)

(73) Assignee: A. O. Smith Corporation, Milwaukee, WI (US)

( * ) Notice: Subject to any disclaimer, the term of this patent is extended or adjusted under 35 U.S.C. 154(b) by 256 days.

(21) Appl. No.: 17/199,919

(22) Filed: Mar. 12, 2021

(65) Prior Publication Data

US 2021/0199344 A1 Jul. 1, 2021

Related U.S. Application Data

(63) Continuation of application No. 15/864,700, filed on Jan. 8, 2018, now Pat. No. 10,948,219.

(60) Provisional application No. 62/443,988, filed on Jan. 9, 2017.

(51) Int. Cl.
*F24H 9/20* (2022.01)
*F24H 1/20* (2022.01)

(52) U.S. Cl.
CPC ..... *F24H 9/2021* (2013.01); *F24H 1/202* (2013.01)

(58) Field of Classification Search
CPC ..... F24H 9/2021; F24H 1/202; F24H 9/2007; F24H 9/20; F24H 19/10; G05B 19/048
See application file for complete search history.

(56) References Cited

U.S. PATENT DOCUMENTS

2006/0257127 A1 11/2006 Patterson et al.
2009/0105888 A1 4/2009 Flohr et al.
2009/0126810 A1* 5/2009 Currie ..... F24D 19/1051 137/624.12
2009/0194601 A1 8/2009 Flohr
2009/0319091 A1 12/2009 Flohr
(Continued)

FOREIGN PATENT DOCUMENTS

CA 2885694 A1 12/2013
WO 2015010006 A1 1/2015

OTHER PUBLICATIONS

Sequentric Energy Systems LLC, "Sequentric Receives Patent for Breakthrough Variable-Capacity Grid-Interactive Water Heater Designed Specifically for Electric Utilities," <http://sequentric.com/media/pdf/vcpr.pdf/> webpage publicly available at least as early as Nov. 8, 2013.

*Primary Examiner* — Brian W. Jennison
(74) *Attorney, Agent, or Firm* — Michael Best & Friedrich LLP

(57) ABSTRACT

A system and method for controlling power to a water heater. The method comprises providing the water heater in a locked state, wherein at least one heating element of the water heater is inoperable when the water heater is in the locked state, coupling a digital key module to a communications port of the water heater, and receiving a digital key from the digital key module through the communications port. The method comprises coupling an electrical grid controller to the water heater through the communications port and placing the water heater in an unlocked state, wherein the at least one heating element of the water heater is operable when the water heater is in the unlocked state.

23 Claims, 6 Drawing Sheets

(56) References Cited

U.S. PATENT DOCUMENTS

| | | | | |
|---|---|---|---|---|
| 2010/0179705 | A1 | 7/2010 | Flohr | |
| 2013/0217359 | A1* | 8/2013 | Cherian | H04L 63/062 455/411 |
| 2015/0026316 | A1* | 1/2015 | Imes | H04L 67/10 709/227 |
| 2018/0106501 | A1* | 4/2018 | Hinton | F24H 9/1818 |

* cited by examiner

ELECTRONIC UNLOCK FEATURE

RELATED APPLICATIONS

This application is a continuation of U.S. patent application Ser. No. 15/864,700, filed on Jan. 8, 2018, which claims priority to U.S. Provisional Patent Application No. 62/443,988, filed Jan. 9, 2017, the entire content of which is incorporated herein by reference.

FIELD

Embodiments relate to water heaters.

SUMMARY

Electric water heaters typically use electrical energy to heat the water located inside a water tank to within a specific temperature range. The electrical energy may come from a power source such as a grid, or power grid, such as but not limited to an energy company power grid or a home power grid including one or more of solar panels, windmills, or other sources. The power grid distributes electrical energy to balance supply and demand at any specific time within a specific area. The demand for electrical energy from the power grid varies with, for example, time of day, season, geographical area, and other factors. The price for the electricity delivered by the power grid varies according to the overall demand on the power grid at a particular time and area. For example, the price of electricity increases during peak hours, and decreases during off-peak hours.

According to the Department of Energy (DOE), since 1982 the growth in peak electricity demand has exceeded power transmission growth. In order to lower the demand for electricity, a new U.S. Department of Energy efficiency standards has been enacted. Large electric water heaters over 55 gallons will be required to have an energy factor of at least 1.97, about double the efficiency of a high-efficiency electric storage water heater. The new standard could only be met with heat-pump water heaters, instead of the classic electric resistance water heaters. Another way to solve the electricity demand problem is to shift the peak demand through storage.

By using advanced digital communication technologies, smart appliances are able to communicate with local power company or home energy management systems, and be managed accordingly to save energy and money.

Some water heaters may communicate their operating status to the grid and be managed remotely by the grid. For example, the water heater may be turned on when renewable energy, such as wind, is available (renewable integration/thermal energy storage), off during peak energy consumption periods (peak shaving), or on or off depending on load to manage power generation (load balancing) while other water heaters demand electrical energy based solely on the temperature of the water with respect to the specific temperature range. Furthermore, upgrading water heaters to consume energy only (or mostly) during certain off-peak hours may require a different control unit and/or system to be installed in the water heater, making it a costly investment for the water heater manufacturer, and ultimately, the end user.

The Energy Efficiency Improvement Act of 2015 allows for grid-enabled water heaters of 75 gallons or more to still be manufactured and sold provided that such water heaters are limited to a heating capacity of less than or equal to approximately 50% of their first hour rating and that such water heaters also be equipped with an activation lock. Utilities will have to report annually on how many new greater than 75 gallon grid-enabled water heaters are added in utility programs within their territory for demand response. The manufacturer or private labeler may provide an activation lock key for a grid-enabled water heater to a utility or other company that operates an electric thermal storage or demand response program that uses such a grid-enabled water heater. The activation lock key will allow the water heater to be unlocked so that the water heater can then heat the water heater to its full first hour rated capacity.

One embodiment provides a method of operating a water heater receiving electrical power from an electrical grid. The method includes providing a water heater in a locked state. A digital key module may be communicatively coupled (for example, via wired or wireless communication) to the water heater and used to unlock the water heater placing the water heater into an unlocked state. Such unlocking of the water heater must only be done for such water heaters that are enrolled in a utility demand response program.

Some embodiments provide the method further including a first heating element and a second heating element. The second element may be inoperable when the water heater is in the locked state and operable when the water heater is in the unlocked state.

Some embodiments provide the method further including broadcasting a Service Set Identifier (SSID) which includes the serial number of the digital key used to unlock a water heater via a digital key module.

Another embodiment provides a water heater including a tank configured to hold a fluid, a first heating element configured to manipulate a temperature of a first portion of the fluid, a second heating element configured to manipulate a temperature of a second portion of the fluid, and a controller having a memory and an electronic processor. The controller is configured to place the water heater in a locked state, receive a digital key from an external device, and place the water heater in an unlocked state once the digital key is received from the external device.

Other aspects of the application will become apparent by consideration of the detailed description and accompanying drawings.

DETAILED DESCRIPTION

Before any embodiments of the application are explained in detail, it is to be understood that the application is not limited in its application to the details of construction and the arrangement of components set forth in the following description or illustrated in the following drawing. The application is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
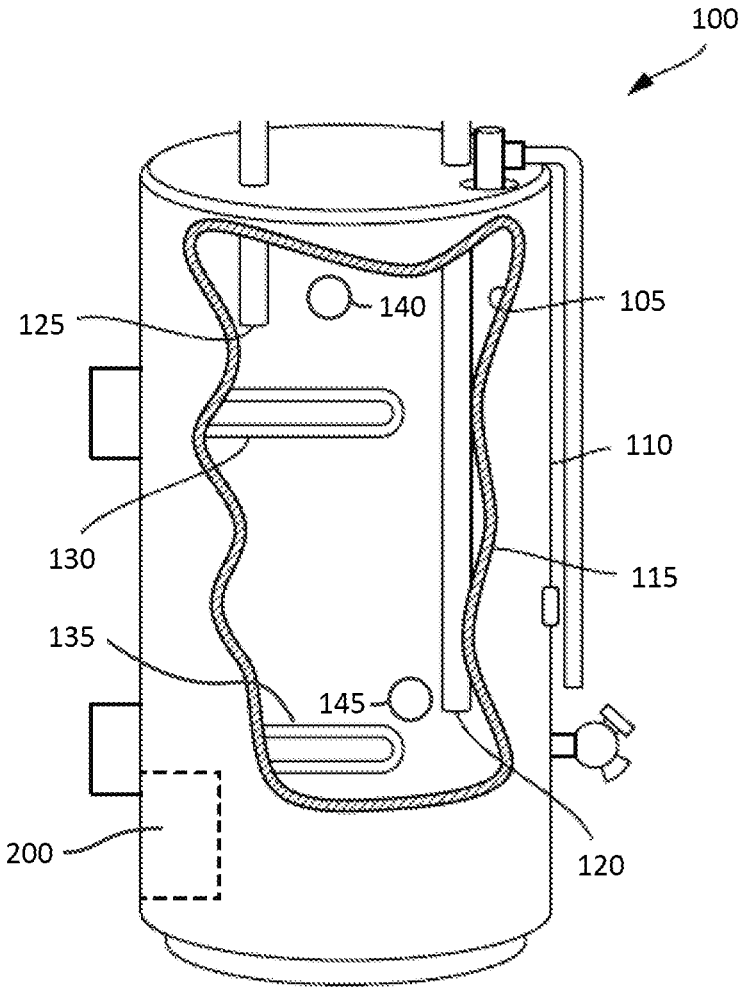
FIG. 1 is a partial exposed view of a water heater according to some embodiments of the application.

FIG. 1 is a partial exposed view of a storage-type water heater 100 according to some embodiments of the application. The water heater 100 includes an enclosed water tank 105, a shell 110 surrounding the water tank 105, and foam insulation 115 filling an annular space between the water tank 105 and the shell 110. The water tank 105 may be made of ferrous metal and lined internally with a glass-like porcelain enamel or other materials to protect the metal from corrosion. In other embodiments, the water tank 105 may be made of other materials, such as plastic or stainless steel.

The water heater 100 also includes an inlet opening 120, an outlet opening 125, an upper heating element 130, a lower heating element 135, an upper temperature sensor 140, a lower temperature sensor 145, and a control system 150. The inlet opening 120 adds cold water to the water tank 105 and the outlet opening 125 withdraws hot water from the water tank 105 for delivery to a user.

The upper heating element 130 is attached to an upper portion of the water tank 105 and extends into the water tank 105 to heat the water within the water tank 105. The upper heating element 130 is coupled to a controller 201 (FIG. 2) to receive an activation signal. When activated, the upper heating element 130 heats the water stored in an upper portion of the water tank 105. In one embodiment, the upper heating element 130 is an electric resistance heating element. In other embodiments, the upper heating element 130 may be a different type of heating element.

The lower heating element 135 is attached to a lower portion of the water tank 105 and extends into the water tank 105 to heat the water stored in the lower portion of the water tank 105. The lower heating element 135 is coupled to the controller 201 to receive an activation signal. When activated, the lower heating element 135 heats the water stored in the lower portion of the water tank 105. In this embodiment, the lower heating element 135 is an electric resistance heating element. In other embodiments, the lower heating element 135 may be a different type of heating element/technology or other means of conveying heat, such as a heat pump.

Although in the illustrated embodiment, two heating elements 130, 135 are shown, any number of heating elements may be included in the water heater 100. The application may also be used with other fluid-heating apparatus for heating a conductive fluid, such as an instantaneous water heater or an oil heater, and with other heater element designs and arrangements. In some embodiments, only one of the upper heating element 130 and the lower heating element 135 operates at a time. In other words, the upper heating element 130 and the lower heating element 135 may not operate simultaneously. In such embodiments, the controller 201 prioritizes activation of the upper heating element 130. Because the outlet opening 125 is positioned in the upper portion of the water tank 105, water is withdrawn from the water tank 105 from the upper portion of the water tank 105. Therefore, prioritizing activation of the upper heating element 130 helps ensure that the water withdrawn from the water tank 105 is at the specified setpoint (e.g., a user-defined setpoint). The lower heating element 135 then operates once the water in the upper portion has reached the specified setpoint.

The upper temperature sensor 140 is positioned in the upper portion of the water tank 105 to determine a temperature of the water stored in the upper portion of the water tank 105. Analogously, the lower temperature sensor 145 is positioned in the lower portion of the water tank 105 to determine a temperature of the water in the lower portion of the water tank 105. The upper temperature sensor 140 and the lower temperature sensor 145 may be attached to the water tank 105, and may include, for example, thermistor type sensors. The upper temperature sensor 140 and the lower temperature sensor 145 are coupled to the control system 200 to periodically provide the sensed temperatures to the controller 201. In some embodiments, the water tank 105 may include more temperature sensors to provide a more accurate indication of the temperature of water inside the water tank 105. For example, the water tank 105 may be divided into three or more portions and a temperature sensor may be positioned in each portion.

Figure 2:
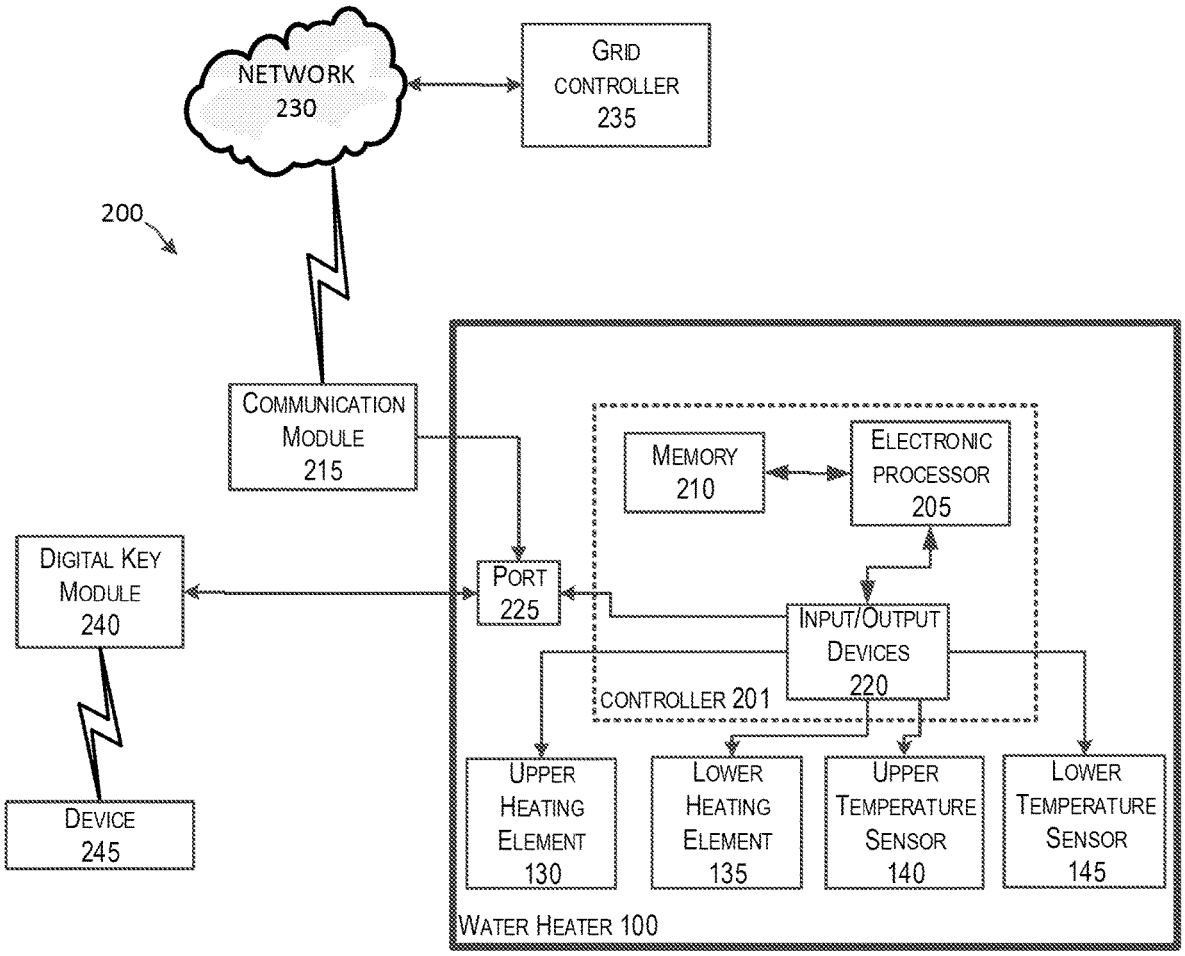
FIG. 2 is a schematic diagram of a control system of the water heater of FIG. 1 according to some embodiments of the application.

FIG. 2 illustrates a schematic diagram of the control system 200. In the illustrated embodiment, the control system 200 is electrically and/or communicatively coupled to the water heater 100. In some embodiments, the control system 200, or at least part of the control system 200 may be located remotely from the water heater 100. The control system 200 includes combinations of hardware and software that are operable to, among other things, control the operation of the water heater 100. As shown in FIG. 2, the water heater 100 includes a controller 201. The controller 201 includes an electronic processor 205, a memory 210, and input/output devices 220.

The controller 201 is coupled to the upper heating element 130, the lower heating element 135, the upper temperature sensor 140, and the lower temperature sensor 145. The controller 201 receives the temperature signals from the upper temperature sensor 140 and the lower temperature sensor 145. Based on the received temperature signals, the controller 201 may control power to the upper heating element 130 or the lower heating element 135.

A communication module 215 is communicatively coupled to the controller 201 through a communication port 225. The communication module 215 communicates with a network 230. The communication module 215 can be WiFi or other wired or wireless communication technology, and may include a port adapter as part of the communication module. The network 230 receives and/or stores information regarding an electrical grid from a grid controller 235. The electrical grid distributes electrical energy to various consumers. The grid controller 235 monitors the electrical grid. For example, the grid controller 235 may monitor the current and/or expected demand on the electrical grid. The grid controller 235 provides specific commands and/or regulation signals to the network 230 to help monitor and balance the demand on the electrical grid. The grid controller 235 may provide regulation signals, for example, to control the load from a particular consumer or set of consumers (e.g., in a particular geographical region), control operation of appliances (e.g., water heater 100), and the like. These regulation signals allow the grid controller 235 to have a more precise control over the demand on the electrical grid. The grid controller 235 may also send other commands to the water heater 100 such as, for example, a "Shed Load" signal to decrease the electrical load from the water heater 100. Additionally, or alternatively, the grid controller 235 may provide information to the network 230 regarding, for example, on-peak times, off-peak times, pricing information, and the like. In such an embodiment, the water heater 100 may operate in accordance with such information.

The communication module 215 receives regulation signals and information concerning the electrical grid through the network 230, and sends the information to the electronic processor 205. In some embodiments, the grid controller 235 is operated by the utility. In other embodiments, the grid controller 235 is operated by a third-party. In such an embodiment, the third-party may be a third-party aggregator. In such an embodiment, the third-party aggregator monitors the grid independently of the utility and sends demand response signals to the water heater 100 based on such monitoring.

The electronic processor 205 is communicatively coupled to the memory 210 and to the input/output device ports 220, including the communication port 225. The electronic processor 205 receives the regulation signals, commands, and the electrical grid information (e.g., demand times and/or pricing information) through the communication module 215 and port 225. The electronic processor 205 also receives information regarding the operation of the water heater 100 through the input/output devices 220 connected. The electronic processor 205 may receive command signals from the network 230 and determine control signals based on the command signals received. The electronic processor 205 then outputs the control signals to the input/output devices 220.

Although in the illustrated embodiment, the grid controller 235 provides control signals and/or information regarding the electric grid to a single water heater 100, in other embodiments, the grid controller 235 may be connected to several water heaters and may be able to provide various control signals to various water heaters and/or other appliances.

The memory 210 stores algorithms and/or programs used to control the upper heating element 130, the lower heating element 135, and other components of the water heater 100. The memory 210 may also store historical data, usage patterns, and the like to help control the water heater 100.

The input/output devices 220 output information to the user regarding the operation of the water heater 100 and also receive inputs. In some embodiments, the input/output devices 220 may include a user interface for the water heater 100. The input/output devices 220 may include a combination of digital and analog input or output devices required to achieve level of control and monitoring for the water heater 100. For example, the input/output devices 220 may include a touch screen, a speaker, buttons, and the like to receive user input regarding the operation of the water heater 100 (for example, a temperature set point at which water is to be delivered from the water tank 105). The electronic processor 205 also outputs information to the user in the form of, for example, graphics, alarm sounds, and/or other known output devices. The input/output devices 220 may be used to control and/or monitor the water heater 100. For example, the input/output devices 220 may be operably coupled to the controller 201 to control temperature settings of the water heater 100. For example, using the input/output devices 220, a user may set one or more temperature set points for the water heater 100.

The input/output devices 220 are configured to display conditions or data associated with the water heater 100 in real-time or substantially real-time. For example, but not limited to, the input/output devices 220 may be configured to display measured electrical characteristics of the upper heating element 130 and lower heating element 135, the temperature sensed by temperature sensors 140, 145, etc. The input/output devices 220 may also include a "power on" indicator and an indicator for each heating element 130, 135 to indicate whether the element is active. The input/output devices 220 may be mounted on the shell of the water heater, remotely from the water heater 100 in the same room (e.g., on a wall), in another room in the building, or even outside of the building. In some embodiments, the input/output devices 220 may also generate alarms regarding the operation of the water heater 100.

In operation, the upper heating element 130 heats the water stored in an upper portion of the water tank 105 while the lower heating element 135 heats water stored in a lower portion of the water tank 105, allowing effective heating of the full capacity of water inside the water tank 105. However, for large storage tanks, a significant amount of energy is required to heat the full capacity of the water tank 105. Thus, in some embodiments, at least one of the upper heating element 130 and the lower heating element 135 may be in a locked state. For example, when in the locked state, the lower heating element 135 inside the water tank 105 of the water heater 100 is disabled. Thus, effective heating is provided only for the water at the top half of the water tank 105.

In order to unlock water heater 100, a digital key module 240 may be coupled to the communication port 225 connected to the electronic processor 205. The digital key module 240 stores a unique digital key serial number. In some embodiments, port 225 is a "smart port" communications port. In some embodiments, the digital key module 240 is a wireless communication module configured to communicate with an external device 245 using a wireless communication protocol (for example, Bluetooth, Wi-Fi, ZigBee, etc.). In some embodiments, the digital key module 240 may broadcast the serial number of the digital key that was used to unlock the water heater and/or other information which may be visible to an external device 245.

Figure 3:
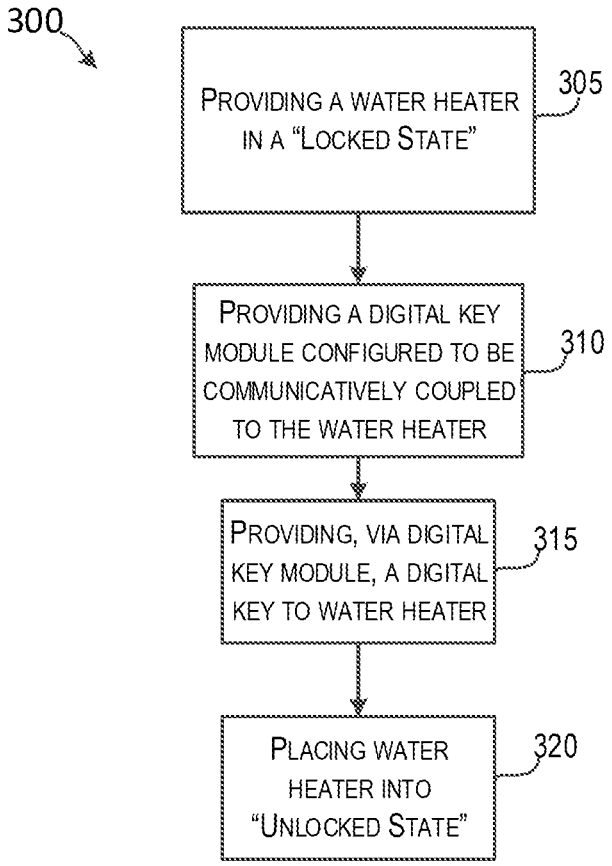
FIG. 3 is a flowchart illustrating a method of operating the water heater of FIG. 1 according to some embodiments of the application.

FIG. 3 is a flowchart illustrating a process, or method, 300 of operating the water heater 100 according to an embodiment of the application. It should be understood that the order of the steps disclosed in process 300 could vary. Furthermore, additional steps may be added to the control sequence and not all of the steps may be required. As shown in FIG. 3, initially, the water heater 100 is provided in the locked state (block 305). As discussed above, when the water heater 100 is in a locked state, at least one of the heating elements, 130, 135 is inoperable. At block 310, the digital key module 240 is communicatively coupled to the water heater 100 (for example, via port 225). A user-actuated device, such as a button or a switch, on the digital key module 240 is pressed. A digital key stored in a memory of the digital key module 240 is provided to the water heater 100 (block 315). When the digital key provided is validated, the water heater 100 is placed into an unlocked state, allowing operation of both the heating elements, 130,135 (block 320), and the serial number of the digital key is stored in the memory of the controller 201.

Figure 4:
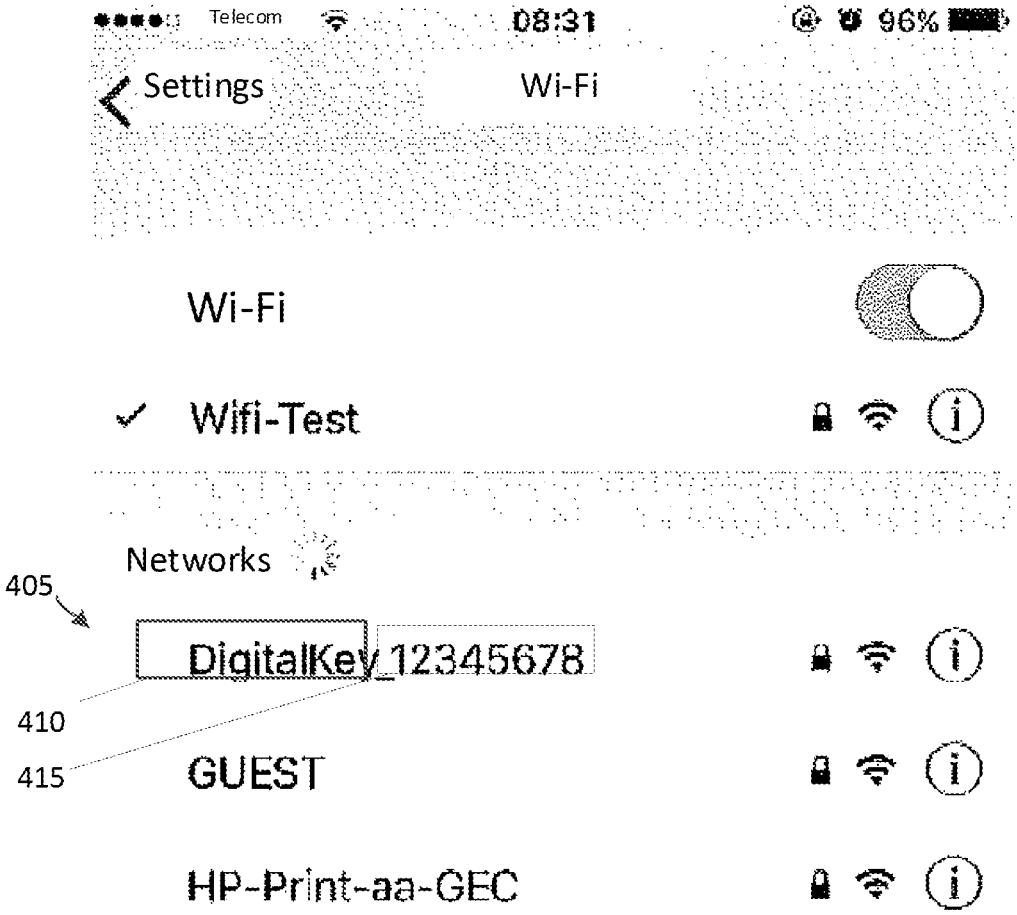
FIG. 4 is a user-interface of the control system of FIG. 2 whereby the serial number of the digital key used to unlock the water heater is displayed as part of an SSID.

FIG. 4 is an exemplary illustration of the network digital key module 240 may broadcast, at block 320 of FIG. 3. At block 320, the digital key module 240 may start an access point and broadcast a Service Set Identifier (SSID) 405 including the serial number 415 of the digital key that was used to unlock the water heater 100. A visual indication, such as an illumination of a LED on the digital key module 240, may be used to indicate the lock/unlock status of the water heater 100. Following block 320, the digital key module 240 may be unplugged from the water heater 100 and be used for additional installations.

Water heater 100 may be locked, after being unlocked, and at least one heating elements, 130, 135 disabled, by the user-actuated device, such as a button or a switch, on the digital key module 240 is pressed for a predetermined time period while communicatively coupled to the water heater 100 until a visual and/or audible indication on the module indicates the heater is locked. At least one of the heating elements, 130, 135, is then disabled.

Figure 5:
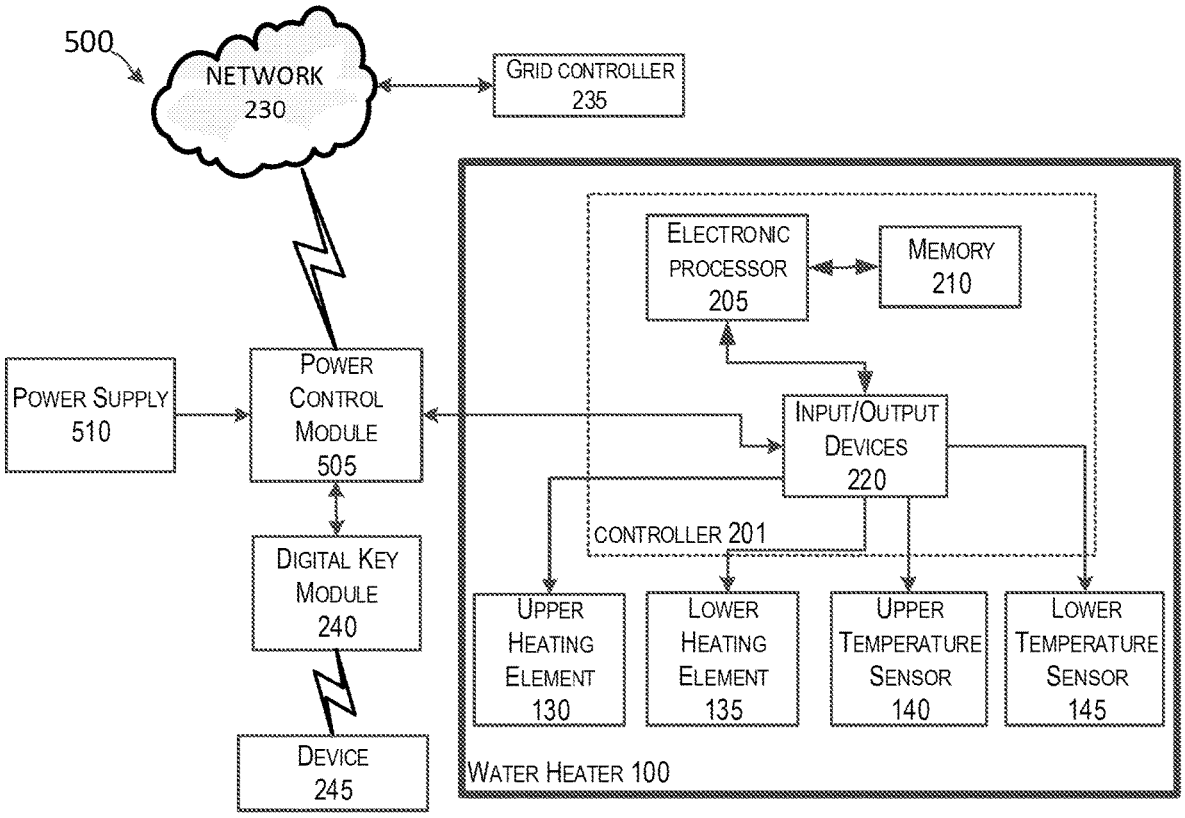
FIG. 5 is a schematic diagram of a control system of the water heater of FIG. 1 according to another embodiment of the application.

FIG. 5 illustrates a schematic diagram of another control system 500 according to some embodiments. The control system 500 may operate similar to the control system 200 of FIG. 2. Control system 500 further includes a power control module 505. The power control module 505 is configured to selectively control power from power source 510 to the water heater 100. The power control module 505 is communicatively coupled to the grid controller 235 via network 230.

Figure 6:
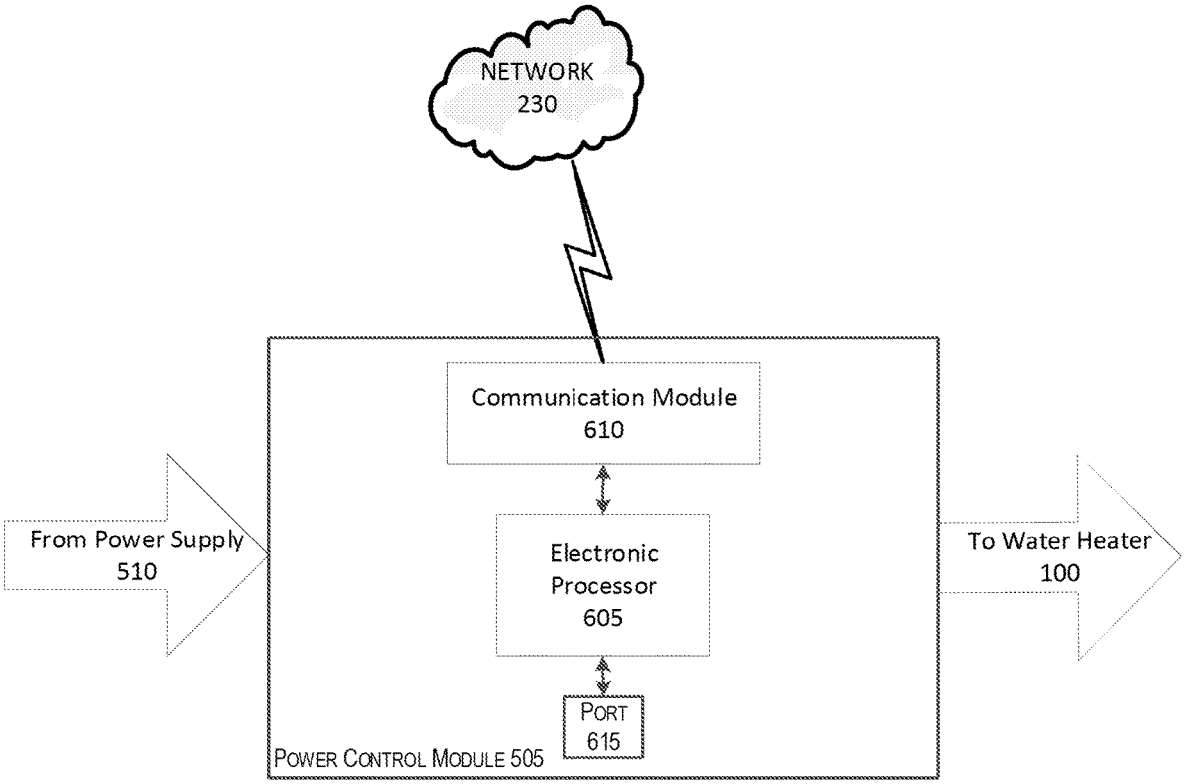
FIG. 6 is a schematic diagram of the control module of FIG. 5 according to some embodiments of the application.

FIG. 6 illustrates a schematic diagram of the power control module 505 of FIG. 5. Power control module 505 includes an electronic processor 605, a communication module 610, and a port 615. The communication module 610 and the port 615 may operate similar to the communication module 215 and smart port 225 of FIG. 2. The digital key module 240 may be coupled to the port 615 communicatively coupled to the controller 201 of the water heater 100 as illustrated in FIG. 2.

In operation, the power control module 505 initially prohibits power to the water heater 100. Upon connecting to the grid controller 235, the power control module 505 allows power from the power source 510 to the water heater 100. In some embodiments, similar as discussed above in regards to FIG. 3, while the digital key module 240 is communicatively coupled to the power control module 505 through the port 615, a user-actuated device, such as a button or a switch, on the digital key module 240 is pressed. A digital key stored in a memory of the digital key module 240 is then provided to the water heater 100 and/or the grid controller 235. When the digital key provided is validated, the power control module 505 allows the water heater 100 to receive power from the power source 505, allowing operation of both the heating elements, 130,135. The serial number of the digital key is then stored in the memory of the electronic processor 600.

Various features and advantages of the application are set forth in the following claims.

What is claimed is:

1. A water heater comprising:
a tank configured to hold a fluid;
at least one heating element arranged within the tank;
a controller having a memory and an electronic processor; and
a communication port communicatively coupled to the controller, the communication port configured to:
couple to a digital key module and transmit a digital key from the digital key module to the controller; and
connect the water heater to an electrical grid controller,
wherein the controller is configured to activate the at least one heating element only after the water heater has connected to the electrical grid controller and the controller has received the digital key.

2. The water heater of claim 1, wherein the at least one heating element is at least one of a plurality of heating elements arranged within the tank, wherein the controller is configured to activate the at least one of the plurality of heating elements without having received the digital key.

3. The water heater of claim 1, wherein the at least one heating element is arranged within a lower portion of the tank.

4. The water heater of claim 1, wherein the digital key is provided from the digital key module upon actuation of a user-actuated device.

5. The water heater of claim 1, wherein the digital key is provided to the digital key module via an external device communicatively coupled to the digital key module.

6. The water heater of claim 1, wherein the controller is configured to validate the digital key.

7. The water heater of claim 1, wherein the controller is configured to store a serial number of the digital key in the memory.

8. The water heater of claim 1, further comprising an input/output device configured to display an indication of whether the at least one heating element is activated.

9. The water heater of claim 1, wherein the communication port is configured to receive electrical grid information from the electrical grid controller.

10. The water heater of claim 1, wherein the digital key module broadcasts a serial number of the digital key only after the water heater has connected to the electrical grid controller and the controller has received the digital key.

11. A method of controlling power to a water heater, the method comprising:
providing the water heater in a locked state, wherein at least one heating element of the water heater is inoperable when the water heater is in the locked state;
coupling a digital key module to a communications port of the water heater;
receiving a digital key from the digital key module through the communications port;
coupling an electrical grid controller to the water heater through the communications port;
placing the water heater in an unlocked state, wherein the at least one heating element of the water heater is operable when the water heater is in the unlocked state; and
broadcasting a Service Set Identifier (SSID) from the digital key module,
wherein the digital key module broadcasts the SSID only after the water heater is placed in the unlocked state.

12. The method of claim 11, wherein the SSID includes a serial number of the digital key.

13. The method of claim 11, further comprising storing a serial number of the digital key in a memory.

14. A method of controlling power to a water heater, the method comprising:
providing the water heater in a locked state, wherein at least one heating element of the water heater is inoperable when the water heater is in the locked state;
coupling a digital key module to a communications port of the water heater;
receiving a digital key from the digital key module through the communications port;
coupling an electrical grid controller to the water heater through the communications port; and placing the water heater in an unlocked state, wherein the at least one heating element of the water heater is operable when the water heater is in the unlocked state, wherein the digital key is provided to the digital key module via an external device communicatively coupled to the digital key module.

15. The method of claim 11, further comprising validating the digital key.

16. A method of controlling power to a water heater, the method comprising:

providing the water heater in a locked state, wherein at least one heating element of the water heater is inoperable when the water heater is in the locked state;

coupling a digital key module to a communications port of the water heater;

receiving a digital key from the digital key module through the communications port;

coupling an electrical grid controller to the water heater through the communications port;

placing the water heater in an unlocked state, wherein the at least one heating element of the water heater is operable when the water heater is in the unlocked state; and displaying an indication of whether the water heater is placed in the unlocked state.

17. The method of claim 11, further comprising receiving electrical grid information from the electrical grid controller through the communications port.

18. The method of claim 14, further comprising storing a serial number of the digital key in a memory.

19. The method of claim 14, further validating the digital key.

20. The method of claim 14, further comprising receiving electrical grid information from the electrical grid controller through the communications port.

21. The method of claim 16, further comprising storing a serial number of the digital key in a memory.

22. The method of claim 16, further validating the digital key.

23. The method of claim 16, further comprising receiving electrical grid information from the electrical grid controller through the communications port.

* * * * *